United States Patent [19]

Kreitzberg

[11] Patent Number: 4,492,339

[45] Date of Patent: Jan. 8, 1985

[54] FLOW CONTROL NOZZLE

[75] Inventor: Jeffrey P. Kreitzberg, Walla Walla, Wash.

[73] Assignee: Nelson Irrigation Corporation, Walla Walla, Wash.

[21] Appl. No.: 471,331

[22] Filed: Mar. 2, 1983

[51] Int. Cl.[3] ..... B05B 3/02

[52] U.S. Cl. ..... 239/230; 239/533.14; 138/45

[58] Field of Search ..... 239/11, 461, 230, 498, 239/500, 502, 504, 516, 518, 519, 521, 522, 533.13, 533.14; 138/45, 46; 137/843, 844, 845, 859

[56] References Cited

U.S. PATENT DOCUMENTS

| | | | |
|---|---|---|---|
| 3,266,737 | 8/1966 | Nees | 239/504 X |
| 4,091,996 | 5/1978 | Nelson | 239/177 |
| 4,228,956 | 10/1980 | Varner | 239/237 |
| 4,454,929 | 11/1984 | Kempton | 138/45 |

*Primary Examiner*—Andres Kashnikow
*Assistant Examiner*—Mary F. McCarthy
*Attorney, Agent, or Firm*—Cushman, Darby & Cushman

[57] ABSTRACT

A nozzle assembly for a sprinkler comprising a rigid structure cooperatively receiving a flat resilient flow control washer in a position such that when the water under pressure is communicated with the upstream side of the washer the periphery of the downstream face remains generally in a retained relative radial position while the remainder is distorted axially in the downstream direction an amount which increases progressively in a direction toward the interior opening of the washer.

The washer has an annular stream defining surface at the juncture between its interior opening and its upstream side for engaging the water under pressure communicated with the upstream side of the washer and forming the same into a stream issuing through the opening having a cross-sectional area and velocity which vary inversely with respect to one another depending upon the pressure of the water under pressure communicated with the upstream side of the washer so that the water flow rate within the stream is generally constant within an operative range of pressures. The rigid structure includes an upstream projection portion operable to cause the stream defining surface of the washer when distorted as aforesaid to form at least one annular portion which is disposed axially upstream with respect to another annular portion thereof such that one portion of the stream engaged by the one surface portion has a greater radially outward component of movement as compared with another portion of the stream engaged by the other annular surface portion thus resulting in a greater diffusion of the one stream portion with respect to the other stream portion.

19 Claims, 13 Drawing Figures

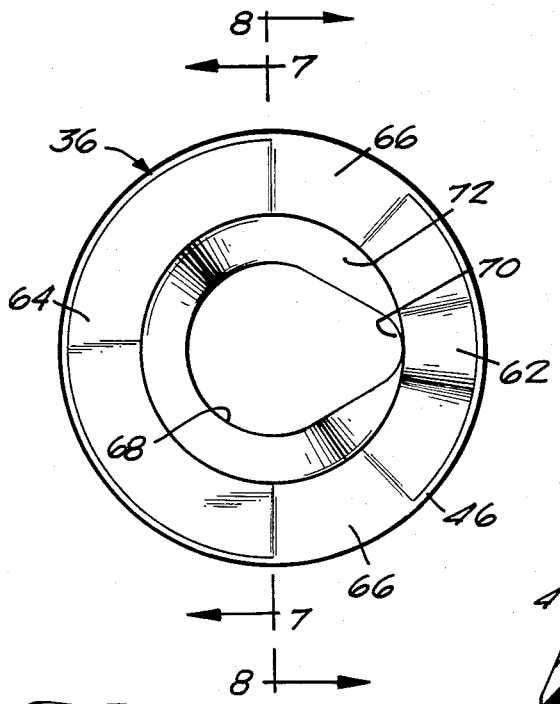
Fig. 6
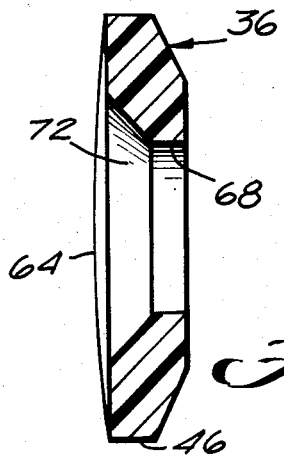
Fig. 7
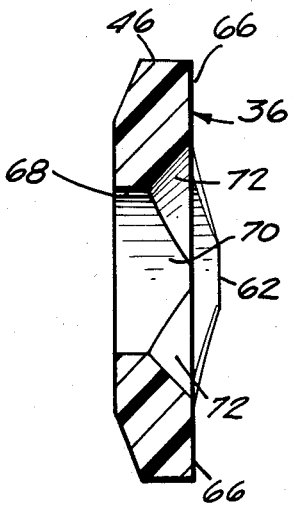
Fig. 8
Fig. 9
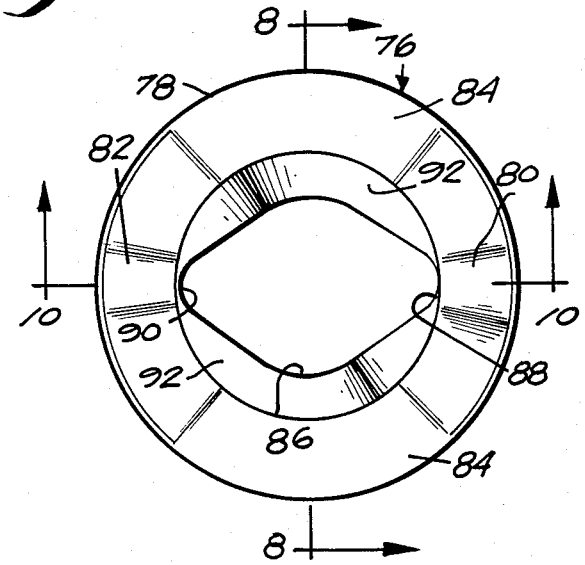
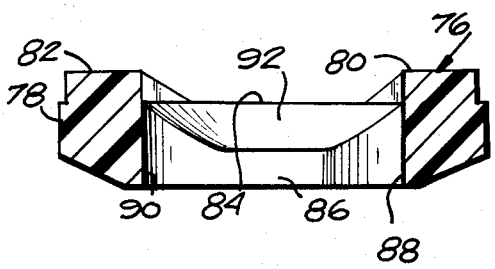
Fig. 10

FLOW CONTROL NOZZLE

This invention relates to improvements in flow control nozzles of the type described in commonly assigned U.S. Pat. No. 4,091,996.

The flow control nozzle disclosed in the above-mentioned patent has been commercially accepted as a significant contribution to the agricultural irrigation sprinkler art in that it is an effective and economical solution to problems in agricultural sprinkler irrigation systems resulting from differences in the distribution rates among sprinklers in the system. The flow control nozzle is an integral part of the sprinkler and therefore has no adverse effect on factors such as durability, maintenance and breakage. Since the water jet flows directly through the flow control nozzle into the atmosphere there are only minor head losses due to the flow control nozzle itself. Finally, it is economical and simple to mount or apply to existing sprinkler heads.

The flow control nozzle is particularly effective when used as the discharge nozzle of a step-by-step rotary sprinkler head. The use of flow control nozzles enables the system to operate with wide differences in the individual sprinkler head inlet pressures at lower system pressure than would be the case where flow control is built internally into the system since additional input pressure must be supplied in order to compensate for the pressure drop caused by internal flow control. Nevertheless, there are limits as to the extent of reduction in the operating level of impact sprinkler heads whether provided with flow control nozzles or not, because of the lack of sufficient energy in the stream to cause break-up when the drive spoon is out of the path of the stream. It is generally accepted that for best operation an impact sprinkler with a flow control nozzle should operate at a pressure of 55 to 60 psi and above.

The high cost of energy and the scarcity of water have combined to make it important to operate systems at low pressures in such a way that the distributed water is more efficiently applied with less water lost to windage and the like. In large systems which operate while moving, such as pivot move systems and lateral move or linear move systems, it has become popular to replace the usual series of step-by-step impact sprinkler heads with a series of assemblies each comprising multiple spray heads mounted on a horizontal boom. These boom mounted spray head assemblies are expensive but enable the system to operate at substantially lower pressure by providing a greater number of sprinkler heads having significantly smaller pattern areas but spread out so as to cover generally comparable total pattern area. These boom mounted spray head assemblies are especially effective in systems such as pivot move or linear move systems where the water is distributed in conjunction with system movement. There still exists a large number of systems which cannot be effectively retrofitted or redesigned to utilize boom mounted spray head assemblies in lieu of step-by-step impact sprinkler heads. For example, wheel lines are still quite popular as systems utilized in fields where pivot move and lateral move systems have not proven economical. These systems operate to apply the water while stationary but are moved from one stationary operating position to another with relative frequency. Hand line systems are similar. While hand line systems are no longer popular as initial installations, nevertheless there are many, many existing installations which could be made more economical if there were an effective way of operating them at lower pressures.

Variation in the flow rate as between particular sprinkler heads in a system requires flow regulation of some sort when the variation approaches and exceeds 20%. Moving systems, whether intermittently moved between stationary operations or whether moved during operation, provide the greatest possibility of variation because in uneven fields movement changes the operating height of many, if not all of the heads in the system. The amount of pressure variation is a function of the height difference and is independent of the operating pressure. Consequently, the amount of pressure differential due to change in operating height becomes a greater portion of the total operating pressure as attempts are made to operate at lower and lower operating pressures. Flow control in moving systems therefore becomes even more important as the operating pressures are lowered. By the same token, the use of flow control nozzles is clearly indicated in existing intermittently moved systems which are to operate at lower pressures, however as previously indicated, known flow control nozzles of the type disclosed in the aforesaid patent present the difficulty when operated at pressures within the range of 30 to 35 that the stream issuing therefrom when the drive spoon is out of the stream path does not have sufficient velocity energy to effect the desired stream break-up. The result is that the stream tends to remain together and fall in a donut pattern on the ground. In extreme cases the droplet size may become large enough to cause damage, particularly in soils which have been newly planted.

Efforts have been made to provide means for effectively breaking up the stream so as to permit conventional impact sprinkler heads to operate more uniformly at the lower pressures. One approach to the problem is to modify the stream at a position beyond the point of interception by the drive spoon by physical diffusing elements. With proposals of this type an existing system could be retrofitted for effective 30 to 35 psi operation by replacing the conventional nozzle with a flow control nozzle and by providing the additional stream diffusing assembly. The need to provide the latter assembly increases the costs and effort involved.

This increase in cost and effort is eliminated in the flow control nozzle assembly disclosed in U.S. Pat. No. 4,228,956 wherein the stream diffusing elements are moved from their previous position outwardly of the position of stream interruption by the drive spoon into a position inwardly of the drive spoon position. With this arrangement the stream diffusing elements are mounted on the nozzle assembly itself thus eliminating the need to provide an additional diffusing assembly outwardly of the drive spoon position. In the arrangement of the patent the opening in the rigid wall which supports the deformable flow control nozzle washer is formed with radially inwardly projecting deflector members or lugs which engage the stream immediately after it is formed by the flow control nozzle washer. Diffusion of the stream is accomplished due to the breaking effect of the radially inwardly projecting lugs on the stream.

While the arrangement of the patent does serve to obviate major problems of the prior art there still exist problem areas where improvements are needed. One such problem is the wear to which the radially inwardly projecting lugs are subjected during operation in agricultural sprinkler irrigation systems. These systems usually use a source of water which is considerably more contaminated than city main water which is used in sprinkling lawns. The source of water usually contains considerable sand and grit despite the provision of prefilters. It is well recognized that wear is a distinct problem in operating systems of this type. The wear characteristics of a small projecting lug member of the type embodied in the patented nozzle assembly would be severe since it is placed directly in the stream so as to engage the flow at right angles to block or divert a portion of the same. Wear soon dissipates the effectiveness of the projecting lugs to effect the required stream diffusion. In the range of exemplary embodiments set forth in the patent the lugs extend inwardly a distance which is slightly less than ¼"to a distance which is slightly greater than 1/16". Projections of this size are such that the effects of wear would soon be reflected in diminished performance. Moreover, where stream diffusion is accomplished by elements which block portions of the stream there is always a greater loss in total energy in the stream than is desired to effect the required diffusion.

It is an object of the present invention to provide a nozzle assembly which will achieve all of the advantages of the patented nozzle assembly while at the same time obviating the above-mentioned disadvantages thereof. In accordance with the principles of the present invention this objective is achieved by configuring the flow control nozzle washer and its rigid supporting structure such that when the washer is deformed by the water under pressure the stream defining surfaces of the washer at the juncture between the interior opening thereof and the upstream side thereof include at least one annular portion which is disposed axially upstream with respect to another annular portion thereof so that one portion of the stream engaged by the one surface portion has a greater radially outward component of movement as compared with the other portion of the stream engaged by the other annular surface portion resulting in a greater diffusion of the one stream portion with respect to the other stream portion. By accomplishing the desired diffusion in the formation of the stream the wear characteristics are greatly enhanced and diffusion is accomplished without significant energy dissipation.

Preferably, the washer in its undistorted condition is flat and symmetrical and the rigid structure which supports the downstream face of the washer is configured to effect the unequal axial distortions of portions of the stream defining surfaces.

Where the nozzle assembly is utilized in an impact sprinkler to define the main stream of the sprinkler from which the drive spoon is driven it is preferable to provide a single axially upstream disposed portion located at the lowermost annular portion of the stream so that the diffusion occurs on the lower portion of the stream and the remainder of the stream including the entire upper portion is retained as an integral unit. In situations where a greater amount of diffusion is desired, as for example in a spreader nozzle of a two-nozzle impact sprinkler head, two or three axially upstream disposed annular portions may be provided. Where two are provided they are preferably positioned in diametrically opposed relation so that the resultant stream assumes a fan-shaped configuration. Where three are provided they are preferably equally annularly spaced to effect a diffusion which occurs generally throughout the periphery of the stream.

Accordingly it is a further object of the present invention to provide a nozzle assembly and a sprinkler head embodying such nozzle assembly which is simple in construction, effective in operation and economical to manufacture.

These and other objects of the present invention will become more apparent during the course of the following detailed description and appended claims.

The invention may best be understood with reference to the accompanying drawings, wherein an illustrative embodiment is shown.

In the drawings

FIG. 6 is a rear elevational view of the rigid washer supporting member of the nozzle assembly shown in FIGS. 2–5;

FIG. 7 is a cross-sectional view taken along the line 7—7 of FIG. 6;

FIG. 8 is a cross-sectional view taken along the line 8—8 of FIG. 7 (and of FIG. 9);

FIG. 9 is a view similar to FIG. 6 of a rigid washer supporting member of a modified configuration embodying the principles of the present invention which can be utilized in the nozzle assembly in lieu of the support member of FIG. 6 so as to form a stream which diffuses into a fan-shaped configuration;

FIG. 10 is a cross-sectional view taken along the line 10—10 of FIG. 9;

Figure 1:
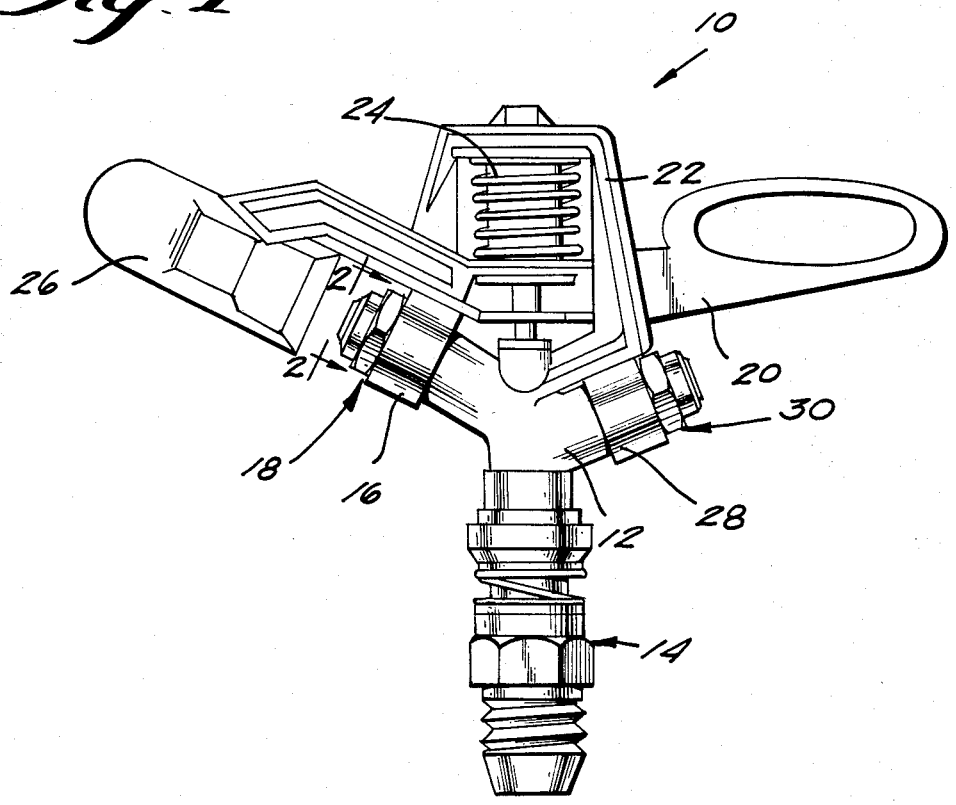
FIG. 1 is a side elevational view of a step-by-step rotary impact sprinkler head embodying the principles of the present invention.
Figure 2:
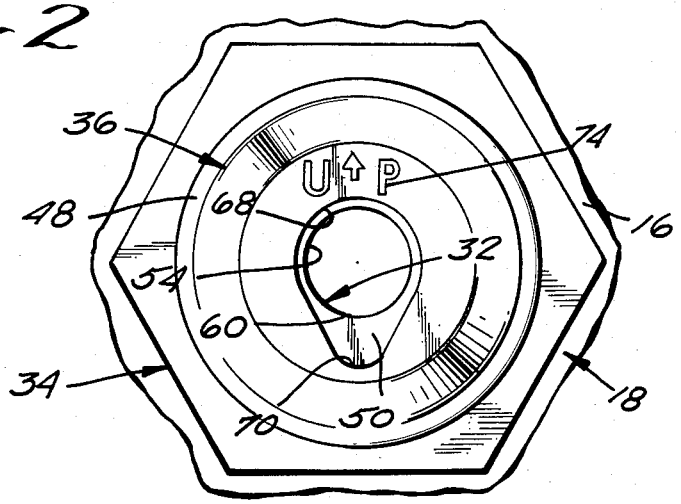
FIG. 2 is a fragmentary front elevational view of the main nozzle assembly of the sprinkler head shown in FIG. 1.

Referring now more particularly to the drawings, there is shown in FIG. 1 thereof a step-by-step rotary sprinkler head, generally indicated at 10, embodying the principles of the present invention. The sprinkler head 10 includes the usual components comprising a hollow sprinkler body 12 having a downwardly opening inlet connected with a bearing assembly 14 of conventional construction. In accordance with conventional practice, the bearing assembly 14 is adapted to be threadedly engaged on the outlet end of a riser pipe or the like and serves to mount the sprinkler head body 12 for controlled rotational movement about an axis which extends vertically in operation. The rotation is controlled by the usual spring means embodied in the bearing assembly 14. Of course, the bearing assembly also conventionally serves to communicate a source of water under pressure with the inlet of the hollow body 12.

The water under pressure communicated with the inlet of the hollow body 12 flows upwardly and outwardly through an outlet 16 within which a nozzle assembly, generally indicated at 18, and embodying the principles of the present invention, is mounted. The sprinkler head 10 also includes an impulse arm 20 which is mounted in the usual fashion above the hollow body 12 for oscillatory movement about an axis which, in the embodiment shown, coincides with the rotational axis of the hollow body. The impulse arm 20 is mounted for oscillatory movement toward and away from a limiting position wherein the arm engages an upwardly extending generally inverted U-shaped mounting structure 22 formed integrally with the hollow body 12. In accordance with conventional procedure, the impulse arm 20 is biased into its limiting position by a coil spring 24 which is connected between the impulse arm and the mounting structure 22. Also in accordance with conventional procedure, the impulse arm 20 has an impact spoon or a reactant element 26 formed thereon in a position to be engaged by the stream of water issuing from the nozzle assembly 18 when the impulse arm is disposed in its limiting position. The reactant element includes the usual outer reactant surface which serves to effect the movement of the impulse arm in a direction away from its limiting position against the bias of the spring 24 and an inner reactant surface which pulls the reactant arm into the stream as the reactant arm approaches the limiting position under the action of the spring 24. It will be understood that the hollow body 12 may be of the type which provides a separate spreader outlet 28 within which a spreader nozzle assembly 30 may be mounted.

The nozzle assembly 18 is constructed in accordance with the principles of the present invention to include a resilient annular washer, generally indicated at 32, retained within a rigid structure consisting of a tubular member, generally indicated at 34, and a disc-like member, generally indicated at 36. The tubular member 36 is made of a rigid material, preferably metal such as brass or the like. As shown, the tubular member 36 includes an upstream end portion 38 which is exteriorly threaded, as indicated at 40, for detachable securement with cooperating interior threads 42 formed in the outlet 16 of the sprinkler body 12. Formed in the upstream portion of the tubular member 38 is a chamber 44 within which the washer 32 is cooperatively received. The chamber 44 is defined by a cylindrical interior wall which serves to determine generally the relative radial position at which the washer 32 is presented to the water under pressure flowing through the sprinkler body outlet 16 and into the upstream end 32 of the tubular member. The disc-like member 36 is also formed of a rigid material. A preferred embodiment of the disc-like member 36 is molded of Delrin ®. It will be understood that other rigid moldable plastic materials may be utilized, such as Celcon ® and that the disc-like member may be made of metal if desired. As shown, the disc-like member 36 is formed with an exterior peripheral projection 46 which is adapted to be seated within the upstream end portion of the chamber 44 and retained therein as by rolling or swaging radially inwardly the upstream extremity of the tubular member 34, as indicated at 48.

Figure 3:
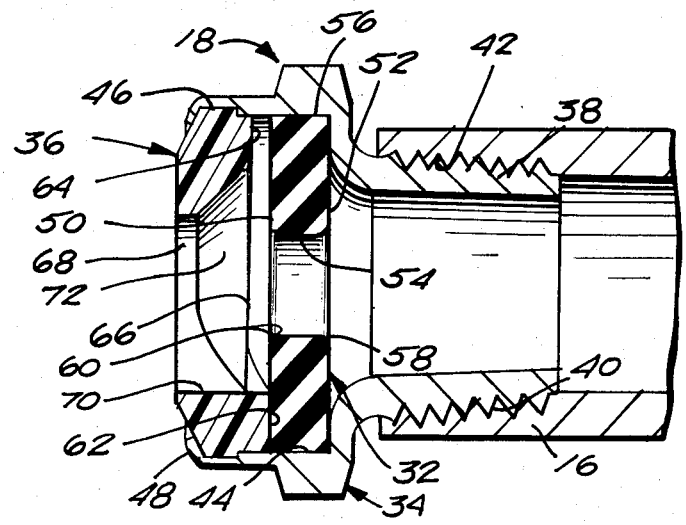
FIG. 3 is a fragmentary cross-sectional view taken along the line 3—3 of FIG. 2, showing the undistorted position of the nozzle washer when the sprinkler head is shut off.

The washer 32 is made of a suitable resilient material. A preferred embodiment of the washer is made of ethylene propylene of 50 durometer. Preferably, the washer is molded into a generally flat configuration so as to include a flat planar surface 50 facing downstream which defines its downstream side and a flat planar surface 52 facing upstream so as to define its upstream side. The flat planar surfaces 50 and 52 are parallel to one another and disposed in planes perpendicular to the axis of an interior opening 54 defined by an interior cylindrical wall concentric with the aforesaid axis. The washer also includes a cylindrical exterior peripheral surface 56 which engages the interior chamber wall 44 when the washer is in a relaxed condition as when the water under pressure is turned off from the sprinkler head, as shown in FIG. 3.

Formed between the juncture of the cylindrical opening 54 and the upstream planar surface 52 is an annular stream defining surface 58. When the washer is in its relaxed undistorted condition, as shown in FIG. 3, the annular stream defining surface is symmetrical about the axis of the opening 54 and has a concavely arcuate cross-sectional configuration uniform throughout its annular extent which merges at its downstream end with the cylindrical wall defining the opening 54 and its upstream end with the planar surface 52 defining the upstream side of the washer. In the drawings, the juncture between the cylindrical opening defining surface 54 and the downstream side of the washer is defined by an annular groove 60. The annular groove is provided for purposes of convenience in the molding operation and performs no function in the operation of the washer when the sprinkler head is connected with a source of water under pressure.

Figure 4:
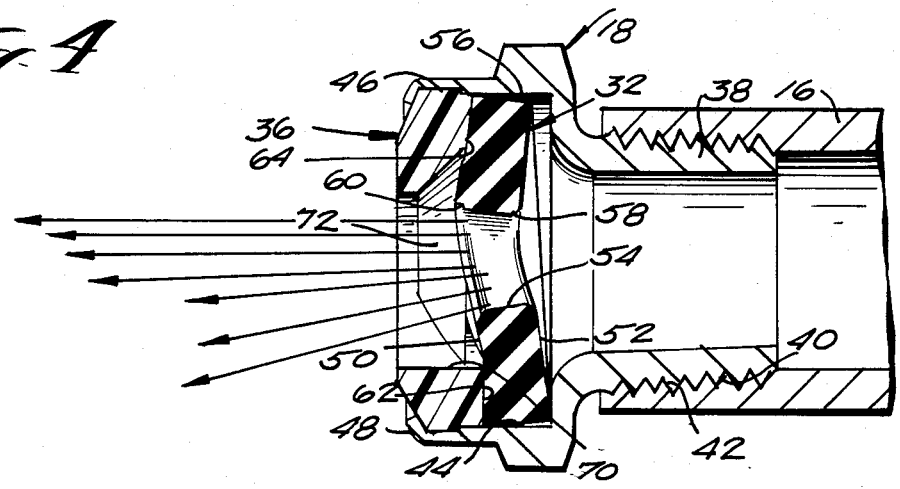
FIG. 4 is a view similar to FIG. 3 showing the distorted position of the nozzle washer when the sprinkler head is operating under a relatively low pressure such as 25 psi.

The disc-like member 36 constitutes a support for the resilient washer 32 which is engaged by the same to effect a controlled distortion thereof in response to the communication of water under pressure therewith from the sprinkler body outlet 16. While it is preferable to form the downstream side of the washer in a flat planar configuration, as by surface 50, and to form the interengaging upstream side of the disc-like member with an irregular surface, it will be understood that both interengaging surfaces could be irregular or the upstream side of the disc member could be planar while all of the irregularity is provided in the downstream side of the washer. As previously indicated, however, in the preferred embodiment shown all of the irregularity is provided in the upstream side of the disc-like member 36. In the embodiment shown in FIGS. 1–8 the upstream side of the disc-like member 36 is formed with a lower annular portion 62 which projects upstream to an extent greater than the remainder of the disc-like member. As shown, the upstream projecting portion 62 is of a configuration defined by moving a radial line perpendicular to the axis of the nozzle assembly through an angle of approximately 4° and then progressively moving the line therefrom in opposite annular directions in conjunction with progressive downstream displacements through annular extents of approximately 40°, making the entire annular portion approximately 84°. The upstream projecting portion 62 causes the corresponding annular portion of the washer 32 engaged thereby and the associated portion of the stream defining surface 58 thereof to assume a position disposed upstream to an extent greater than the position of the remainder of the stream defining surface 58 when the washer is distorted by the communication of water under pressure therewith. This upstream displacement of a portion of the stream defining surface 58 with respect to the remainder causes a corresponding portion of the stream being formed by the surface 58 to have a greater component of radial movement than the remainder of the stream, thus resulting in a greater diffusion of this portion of the stream. The distortion of the washer at a relatively low pressure, such as 25 psi, is illustrated in FIG. 4. The distortion tends to displace the axis of the remainder of the stream and to compensate for this tendency and to insure that the axis of the non-diffused portion of the stream will remain coincident with the axis of the outlet, the upstream side of the disc-like member 36 is formed with a compensating annular portion 64. The annular portion 64 is segmental and extends through a 180° annular extent and provides a surface which slopes radially inwardly in a downstream direction at the central portion thereof at a shallow angular extent with respect to a perpendicular radial plane as, for example 4°. The segmental portion progressively decreases in a direction downstream in both annular directions from the central portion to a perpendicular radial extent. Radially extending planar segmental surface portions 66 serve as transitions between the ends of the compensating segmental portion 64 and the ends of the upstream projecting portion 62.

Extending through the disc-like member 32 is a central opening 68 having a radial enlargement 70 in the annular portion thereof adjacent the upstream projecting portion 62. The size of the opening 68 and radial enlargement 70 is such as to permit the stream defined by the surface 58 of the washer to pass unobstructed therethrough. As best shown in FIGS. 6 and 7, the disc-like member 36 includes a segmental frustoconical transition surface 72 between the inner periphery of the annular surface portions 62, 64 and 66 and the upstream periphery of the opening 68 and enlargement 70.

It will be noted that the enlargement 70 and upstream projecting portion 62 are both disposed lowermost when the nozzle assembly 18 is mounted in the sprinkler head outlet 16 thus insuring that the diffused portion of the stream will likewise be lowermost. This arrangement is preferred since the major upper portion of the stream is retained without diffusion enabling the final upper portions thereof to reach the outermost ends of the sprinkler pattern. To insure that the nozzle assembly is installed in this orientation, the downstream side of the disc-like member 36 is provided with indicia 74 designating the proper orientation, as is clearly shown in FIG. 2.

Figure 5:
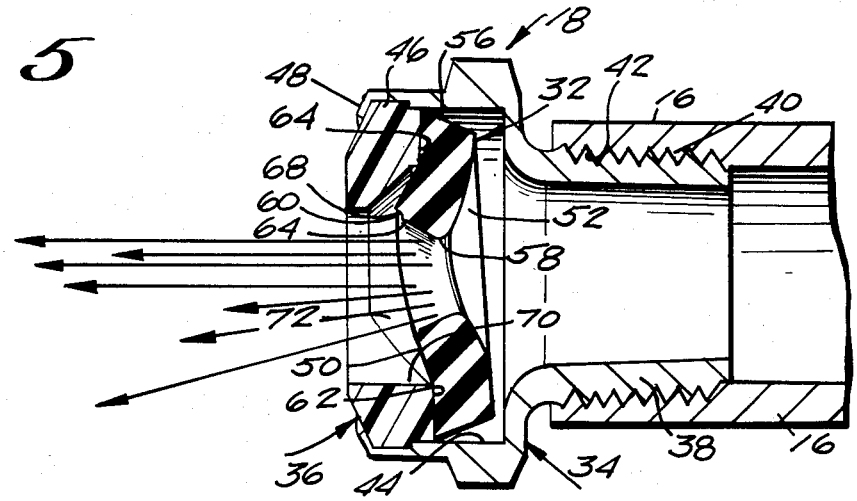
FIG. 5 is a view similar to FIG. 4 showing the distorted position of the nozzle washer when the sprinkler head is operating under a relatively high pressure such as 40 psi.

Referring now more particularly to FIG. 5, this view is similar to FIG. 4 but illustrates the position of distortion of the washer 32 when a relatively high pressure, such as 40 psi, is communicated with the nozzle assembly 18 through the sprinkler head outlet 16. It will be noted that the cross-sectional size of the stream defining surface 58 has been diminished while the relative upstream disposition of the lower annular portion of the washer 32 engaging the upstream portion 62 of the disc-like member 36 is retained with respect to the remainder of the stream defining surface 58. Moreover, the direction of the major axis of the stream remains unchanged. The effect of diminishing the cross-sectional size of the stream defining surface 58 is to decrease the cross-sectional area of the formed stream. Concurrently with the diminishing of the cross-sectional area of the stream, the velocity of the stream is increased. Thus, within an operative range of pressures the washer also serves to inversely vary the cross-sectional area of the stream and the stream velocity so that a relatively constant flow rate or quantity of water per unit time is maintained in the stream irrespective of the pressure within the sprinkler head outlet 16. Thus, the nozzle assembly 18 of the present invention is the first to form a stream which is controlled both as to flow rate and diffusion extent throughout an operative range of pressures.

It will be understood that other configurations may be utilized which achieve a greater degree of diffusion of the stream. An advantage of utilizing a flat resilient washer and incorporating all of the irregular surfaces in the rigid disc-like member is that the nozzle assembly can be modified to provide greater diffusion simply by choosing a different disc-like member and replacing it in the assembly 18 in lieu of the disc-like member 36 previously described.

FIGS. 9 and 10 illustrate a modified disc-like member 76 which is configured to controllably distort the washer 32 into an operating condition in which the stream defined by the surface 58 is diffused at two diametrically opposed portions into a fan-shaped configuration. Disc-like member 76 includes an exterior peripheral projection 78 similar to the projection 46 previously described which functions in a manner similar to that of the projection 46 previously described. The upstream side of the disc-like member 76 is provided with an annular upstream projecting portion 80 which has a configuration substantially identical with the configuration of the upstream projecting portion 62 of the disc-like member 36. However, instead of the compensating annular portion 64, the disc-like member 76 is provided with a second annular upstream projecting portion 82 which has a construction similar to the annular portion 80 constituting a mirror image thereof. The ends of the annular portions 80 and 82 are interconnected by flat radially extending transitional segmental surfaces 84. As before, an opening 86 extends centrally through the disc-like member 76, the opening 86 having an enlargement 88 similar to the enlargement 70 of the disc-like member 36 positioned adjacent the annular upstream projecting portion 80 and a second diametrically opposed enlargement 90 adjacent the annular portion 82. As before, segmental frustoconical surfaces 92 form transitions between the inner periphery of the surfaces of the portions 80, 82 and 84 and the upstream edge of the opening 86 and the enlargements 88 and 90 thereof.

It will be understood that when the disc-like member 76 is assembled with the rigid tubular member 34 and resilient washer 32 in lieu of the disc-like member 36, the diametrically opposed upstream projecting portions 80 and 82 will serve to position corresponding diametrically opposed portions of the stream defining surface 58 of the washer at positions disposed upstream with respect to the remainder of the stream defining surface 58 when the washer is communicated with water under pressure. Since the distorted condition is symmetrical, the compensating portion is not needed and corresponding diametrically opposed portions of the stream will be allowed to have greater radial movements and hence a greater diffusion as the stream moves through the air. It will also be understood that the arrangement provides for this controlled diffusion throughout a range of operating pressures simultaneously with the provision of flow control in a manner similar to that described above with respect to the embodiment of FIGS. 1–8.

Figure 11:
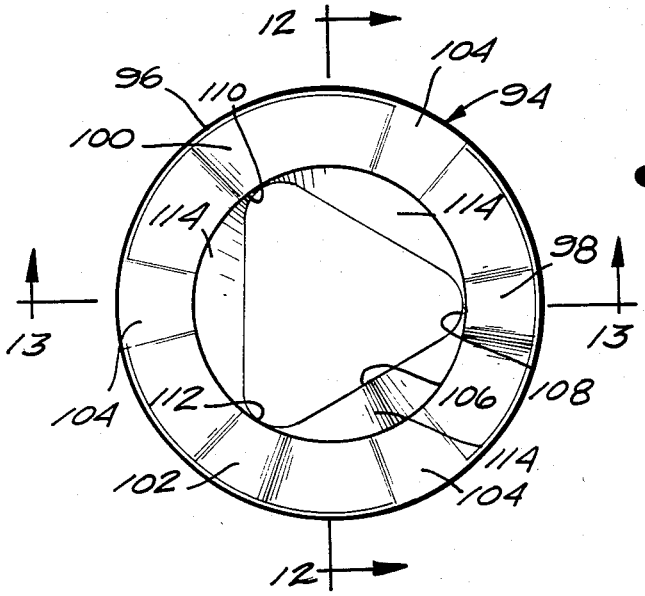
FIG. 11 is a view similar to FIGS. 6 and 9 of still another configuration of a rigid washer supporting member embodying the principles of the present invention which can be utilized in the nozzle assembly in lieu of either the support member of FIG. 6 or the support member of FIG. 9 to form a stream which is diffused substantially throughout its periphery.
Figure 12:
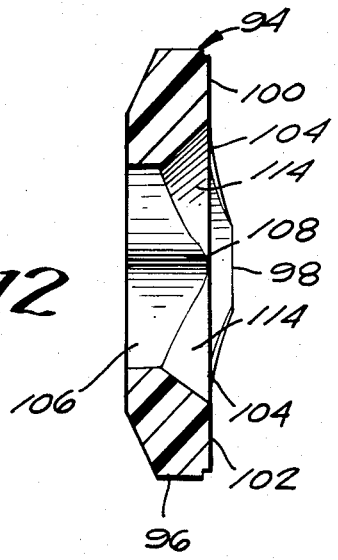
FIG. 12 is a cross-sectional view taken along the line 12—12 of FIG. 11.
Figure 13:
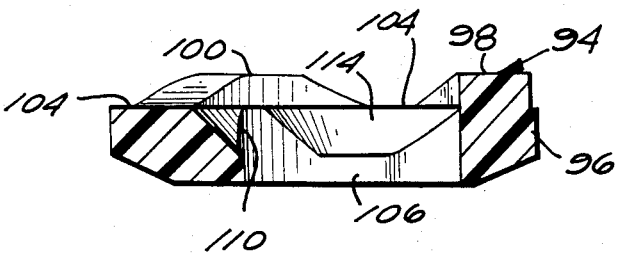
FIG. 13 is a cross-sectional view taken along the line 13—13 of FIG. 11.

FIGS. 11–13 illustrate still another embodiment of a disc-like member 94 which may be utilized in lieu of member 36 or 76. The disc-like member 94 provides a still greater degree of diffusion for the formed stream specifically one in which diffusion is accomplished in three peripheral portions of the stream so that there is a degree of diffusion almost throughout the entire periphery of the stream. In this regard it will be understood that more than three diffusion portions may be provided if desired. Disc-like member 94 includes an exterior peripheral projection 96 similar to the projection 46 previously described which functions in a manner similar to that of the projection 46 previously described. The upstream side of the disc-like member 94 is provided with an annular upstream projecting portion 98 which has a configuration substantially identical with the configuration of the upstream projecting portion 62 of the disc-like member 36. However, instead of the compensating annular portion 64, the disc-like member 94 is provided with a pair of spaced annular upstream projecting portions 100 and 102, each of which has a construction similar to the annular portion 94 constituting a mirror image thereof. The three annular portions 98, 100 and 102 are equally annularly spaced with respect to one another and the adjacent ends of the annular portions are interconnected by three flat radially extending transitional segmental surfaces 104. As before, an opening 106 extends centrally through the disc-like member 94, the opening 106 having an enlargement 108 similar to the enlargement 70 of the disc-like member 36 positioned adjacent the annular upstream projecting portion 98 and a pair of equally spaced enlargements 110 and 112 adjacent the pair of annular portions 100 and 102 respectively. As before, segmental frustoconical surfaces 114 form transitions between the inner periphery of the surfaces of the portions 98, 100 and 102 and the upstream edge of the opening 106 and the enlargements 108, 110 and 112 thereof.

It will be understood that when the disc-like member 94 is assembled with the rigid tubular member 34 and resilient washer 32 (of appropriately decreased durometer) in lieu of the disc-like member 36, the three equally spaced upstream projecting portions 98, 100 and 102 will serve to position corresponding equally spaced portions of the stream defining surface 58 of the washer at positions disposed upstream with respect to the remainder of the stream defining surface 58 when the washer is communicated with water under pressure. Since the distorted condition is symmetrical the compensating portion is not needed and three corresponding equally spaced peripheral portions of the stream will be allowed to have greater radial movements and hence a greater diffusion as the stream moves through the air. It will also be understood that the arrangement provides for this controlled diffusion throughout a range of operating pressures simultaneously with the provision of flow control in a manner similar to that described above with respect to the embodiment of FIGS. 1–8.

The embodiments of FIGS. 9–13 are utilized in any sprinkler application where a greater amount of diffusion is required than is provided by the embodiment of FIGS. 1–8. For example, either could be utilized as the spreader nozzle assembly shown in FIG. 1, as well as the main nozzle assembly 18 thereof. Of course, any of the nozzle assemblies of the present invention may be used in any known sprinkler where desired.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. A nozzle assembly for a sprinkler comprising a resilient annular washer having and upstream side, a downstream side, an exterior periphery extending therebetween and an interior opening extending therebetween, a rigid structure cooperatively receiving said washer, said rigid structure having means for enabling the same to be detachably secured to a sprinkler so as to communicate water under pressure within the sprinkler with the upstream side of said washer, said rigid structure including peripheral surface means generally confining the periphery of said washer so as to determine generally the relative radial position at which said washer is presented for communication with the water under pressure within the sprinkler when said rigid structure is secured thereto, interengaging surface means on the downstream side of said washer and on said rigid structure for enabling said washer to be controllably distorted by the water under pressure communicated with the upstream side thereof such that the periphery of the downstream face remains generally in the aforesaid relative radial position while the remainder is distorted axially in the downstream direction an amount which increases progressively in a direction toward said interior opening, said washer having stream defining surface means at the juncture between said interior opening and said upstream side for engaging the water under pressure communicated with the upstream side of the washer and forming the same into a stream issuing through said opening having a cross-sectional area and velocity which vary inversely with respect to one another depending upon the pressure of the water under pressure communicated with the upstream side of the washer so that the water flow rate within the stream is generally constant within an operative range of pressures, said stream defining surface means when distorted as aforesaid including at least one annular portion which is disposed axially upstream with respect to another annular portion thereof such that one portion of the stream engaged by said one surface means portion has a greater radially outward component of movement as compared with another portion of the stream engaged by said other annular surface means portion thus resulting in a greater diffusion of said one stream portion with respect to said other stream portion.

2. A nozzle assembly as defined in claim 1 wherein said washer when undistorted by water pressure is defined along its interior opening by a cylindrical interior surface and along its upstream side by a generally flat planar surface disposed perpendicular to the axis of said cylindrical interior surface.

3. A nozzle assembly as defined in claim 2 wherein said washer when undistorted by water pressure has its stream defining surface means formed by an annular surface symmetrical with respect to the axis of said cylindrical interior surface and having a convexly arcuate cross-sectional configuration uniform throughout its annular extent which merges with said interior cylindrical surface and with the planar surface of the upstream side of said washer.

4. A nozzle assembly as defined in claim 3 wherein said washer when undistorted by water pressure has the interengaging surface means on the downstream side thereof formed by a generally flat planar surface generally parallel with the flat planar surface defining the upstream side thereof.

5. A nozzle assembly as defined in claim 4 wherein said rigid structure includes a rigid tubular washer containing member, said securement enabling means comprising means on one end of said containing member for fixedly connecting the same to said sprinkler, said containing member having a washer receiving chamber opening from the opposite end thereof and a rigid disc-like member fixedly mounted within the end of said chamber outwardly of said washer, said disc-like member having an upstream side, a downstream side and an opening extending therebetween for the unobstructed passage of the stream therethrough, the interengaging surface means on said rigid structure being formed on the upstream side of said disc-like member and including an annular portion projecting upstream operable to form the one surface means portion of the stream defining surface means of said washer when said washer is distorted by the communication of water under pressure therewith.

6. A nozzle assembly as defined in claim 5 wherein the opening in said disc-like member is enlarged radially at an annular position corresponding with the annular position of the upstream projecting portion of the interengaging surface means on the upstream side thereof.

7. A nozzle assembly as defined in claim 5 wherein the interengaging surface means on the upstream side of said rigid disc-like member includes a segmental portion diametrically opposed to said upstream projecting portion which (1) slopes radially inwardly in a downstream direction at the central portion thereof at a shallow angular extent with respect to a plane perpendicular to the axis of said disc-like member and (2) progressively decreases in angular extent in both annular directions from said central portion to a zero angular extent with respect to said perpendicular plane.

8. A nozzle assembly as defined in claim 6 wherein said stream defining surface means includes a spaced second annular portion which is disposed axially upstream to an extent equal to said one portion when said washer is distorted as aforesaid, the interengaging surface means on the upstream side of said rigid disc-like member including a second annular portion projecting upstream to an extent equal to the first-mentioned upstream projecting annular portion, said second annular portion on said disc-like member being operable to form the second surface means portion of the stream defining surface means of said washer when said washer is distorted by the communication of water under pressure therewith, the opening in said disc-like member being enlarged radially at a second annular position corresponding with the annular position of the second upstream projecting portion of the interengaging surface means on the upstream side of said disc-like member.

9. A nozzle assembly as defined in claim 6 wherein said stream defining surface means includes spaced second and third annular portions which are disposed axially upstream to an extend equal to said one surface means portion when said washer is distorted as aforesaid, the interengaging surface means on the upstream side of said rigid disc-like member including spaced second and third annular portions projecting upstream to an extent equal to the first-mentioned upstream projecting annular portion, said second and third annular portions on said disc-like member being operable to form the second and third surface means portions of the stream defining surface means of said washer when said washer is distorted by the communication of water under pressure therewith, the opening in said disc-like member being enlarged radially at second and third annular positions corresponding with the annular positions of the second and third upstream projecting portion of the interengaging surface means on the upstream side of said disc-like member.

10. A nozzle assembly as defined in claim 1 wherein said one surface means portion comprises one of two diametrically opposed axially upstream disposed annular portions.

11. A nozzle assembly as defined in claim 1 wherein said one surface means portion comprises one of three equally annularly spaced axially upstream disposed annular portions.

12. In an impact sprinkler comprising a sprinkler body, means for connecting said sprinkler body to a source pipe in communicating relation to a source of water under pressure contained therein for controlled step-by-step rotational movement about a vertical axis, said sprinkler body having at least one outlet, a nozzle assembly in said outlet for directing water under pressure communicating with said sprinkler body in a stream extending radially outwardly and upwardly with respect to said vertical axis, an impact arm mounted on said sprinkler body for oscillatory movement to effect the step-by-step rotational movement of said body and a spoon on said arm for engaging the stream issuing from said nozzle assembly to effect the oscillatory movement of said impact arm, the improvement which comprises said nozzle assembly comprising a resilient annular washer having an upstream side, a downstream side, an exterior periphery extending therebetween and an interior opening extending therebetween, a rigid structure cooperatively receiving said washer detachably secured to said sprinkler body so as to communicate water under pressure within the sprinkler body with the upstream side of said washer, said rigid structure including peripheral surface means generally confining the periphery of said washer so as to determine generally the relative radial position at which said washer is presented for communication with the water under pressure within the sprinkler when said rigid structure is secured thereto, interengaging surface means on the downstream side of said washer and on said rigid structure for enabling said washer to be controllably distorted by the water under pressure communicated with the upstream side thereof such that the periphery of the downstream face remains generally in the aforesaid relative radial position while the remainder is distorted axially in the downstream direction an amount which increases progressively in a direction toward said interior opening, said washer having stream defining surface means at the juncture between said interior opening and said upstream side for engaging the water under pressure communicated with the upstream side of the washer and forming the same into a stream issuing through said opening having a cross-sectional area and velocity which vary inversely with respect to one another depending upon the pressure of the water under pressure communicated with the upstream side of the washer so that the water flow rate within the stream is generally constant within an operative range of pressures, said stream defining surface means when distorted as aforesaid including a lower annular portion which is disposed axially upstream with respect to the upper annular portion thereof such that a lower portion of the stream engaged by said lower surface means portion has a greater radially outward component of movement as compared with the upper portion of the stream engaged by said upper annular surface means portion thus resulting in a greater diffusion of the lower stream portion with respect to the upper stream portion.

13. The improvement as defined in claim 12 wherein said washer when undistorted by water pressure is defined along its interior opening by a cylindrical interior surface and along its upstream side by a generally flat planar surface disposed perpendicular to the axis of said cylindrical interior surface.

14. The improvement as defined in claim 13 wherein said washer when undistorted by water pressure has its stream defining surface means formed by an annular surface symmetrical with respect to the axis of said cylindrical interior surface and having a convexly arcuate cross-sectional configuration uniform throughout its annular extent which merges with said interior cylindrical surface and with the planar surface of the upstream side of said washer.

15. The improvement as defined in claim 14 wherein said washer when undistorted by water pressure has the interengaging surface means on the downstream side thereof formed by a generally flat planar surface generally parallel with the flat planar surface defining the upstream side thereof.

16. The improvement as defined in claim 15 wherein said rigid structure includes a rigid tubular washer containing member having means on one end thereof fixedly connecting the same to said sprinkler body and a washer receiving chamber opening from the opposite end thereof and a rigid disc-like member fixedly mounted within the end of said chamber outwardly of said washer, said disc-like member having an upstream side, a downstream side and an opening extending therebetween for the unobstructed passage of the stream therethrough, the interengaging surface means on said rigid structure being formed on the upstream side of said disc-like member and including a lower portion projecting upstream operable to form the lower surface means portion of the stream defining surface means of said washer when said washer is distorted by the communication of water under pressure therewith.

17. The improvement as defined in claim 16 wherein the opening in said disc-like member is enlarged radially at a lower annular position corresponding with the lower annular position of the upstream projecting portion of the interengaging surface means on the upstream side thereof.

18. The improvement as defined in claim 16 wherein the interengaging surface means on the upstream side of said rigid disc-like member includes an upper segmental portion diametrically opposed to said lower upstream projecting portion which (1) slopes radially inwardly in a downstream direction at the central portion thereof at a shallow angular extent with respect to a plane perpendicular to the axis of said disc-like member and (2) progressively decreases in angular extent in both annular directions from said central portion to a zero angular extent with respect to said perpendicular plane.

19. A nozzle assembly for a sprinkler comprising a resilient annular washer having an upstream side defined by a planar surface facing upstream, a downstream side defined by a planar surface facing downstream in generally parallel relation to the planar surface of said upstream side, an exterior periphery extending therebetween and an interior opening extending therebetween, a rigid structure cooperatively receiving said washer, said rigid structure having means for enabling the same to be detachably secured to a sprinkler so as to communicate water under pressure within the sprinkler with the upstream side of said washer, said rigid structure including peripheral surface means generally confining the periphery of said washer so as to determine generally the relative radial position at which said washer is presented for communication with the water under pressure within the sprinkler when said rigid structure is secured thereto, surface means on said rigid structure for engaging the planar surface of the downstream side of said washer in response to the communication of water under pressure with the upstream side thereof so as to cause the washer to be controllably distorted such that the periphery of the downstream face remains generally in the aforesaid relative radial position while the remainder is distorted axially in the downstream direction an amount which increases progressively in a direction toward said interior opening, said washer having stream defining surface means at the juncture between said interior opening and said upstream side for engaging the water under pressure communicated with the upstream side of the washer and forming the same into a stream issuing through said opening having a cross-sectional area and velocity which vary inversely with respect to one another depending upon the pressure of the water under pressure communicated with the upstream side of the washer so that the water flow rate within the stream is generally constant within an operative range of pressures, said washer engaging surface means including at least one annular portion which is disposed axially upstream with respect to another annular portion thereof operable when said washer is distorted into engagement therewith as aforesaid to cause a corresponding annular portion of the stream defining surface means thereof to be disposed axially upstream with respect to another annular portion thereof such that one portion of the stream engaged by said one annular stream defining surface means portion has a greater radially outward component of movement as compared with another portion of the stream engaged by said other annular stream defining surface means portion thus resulting in a greater diffusion of said one stream portion with respect to said other stream portion.

* * * * *